US008420938B2

(12) United States Patent
Setogawa et al.

(10) Patent No.: US 8,420,938 B2
(45) **Date of Patent: *Apr. 16, 2013**

(54) INSULATED ELECTRIC WIRE

(75) Inventors: Akira Setogawa, Hitachi (JP); Tomiya Abe, Hitachi (JP); Yuji Takano, Mito (JP)

(73) Assignees: Hitachi Cable, Ltd., Tokyo (JP); Hitachi Magnet Wire Corp., Ibaraki (JP)

( * ) Notice: Subject to any disclaimer, the term of this patent is extended or adjusted under 35 U.S.C. 154(b) by 205 days.

This patent is subject to a terminal disclaimer.

(21) Appl. No.: 12/717,200

(22) Filed: Mar. 4, 2010

(65) Prior Publication Data

US 2010/0224406 A1 Sep. 9, 2010

(30) Foreign Application Priority Data

Mar. 5, 2009 (JP) ..... 2009-052103

(51) Int. Cl.
*H01B 7/00* (2006.01)

(52) U.S. Cl.
USPC ..... 174/110 R; 174/120 R

(58) Field of Classification Search ..... 174/110 R, 174/120 R
See application file for complete search history.

(56) References Cited

U.S. PATENT DOCUMENTS

| | | | | |
|---|---|---|---|---|
| 5,902,681 | A * | 5/1999 | Ueoka et al. | 428/383 |
| 7,932,468 | B2 * | 4/2011 | Takano et al. | 174/110 R |
| 2002/0043391 | A1 * | 4/2002 | Suzuki et al. | 174/120 R |
| 2010/0014263 | A1 * | 1/2010 | Tsuchida et al. | 361/773 |

FOREIGN PATENT DOCUMENTS

| | | | |
|---|---|---|---|
| JP | 55-3453 | * | 1/1980 |
| JP | 07-134912 | | 5/1995 |
| JP | 09-045143 | | 2/1997 |
| JP | 2007-213908 | | 8/2007 |

* cited by examiner

*Primary Examiner* — Chau Nguyen
(74) *Attorney, Agent, or Firm* — Antonelli, Terry, Stout & Kraus, LLP.

(57) ABSTRACT

There is provided a insulated electric wire with an electric conductor on which at least a lubricating layer is formed, in which a lubricant is added to the lubricating layer so that granular bodies, with sizes of 5 nm to 3 μm, which are formed by coagulation of the lubricant disperse on a surface of the lubricating layer.

17 Claims, 1 Drawing Sheet

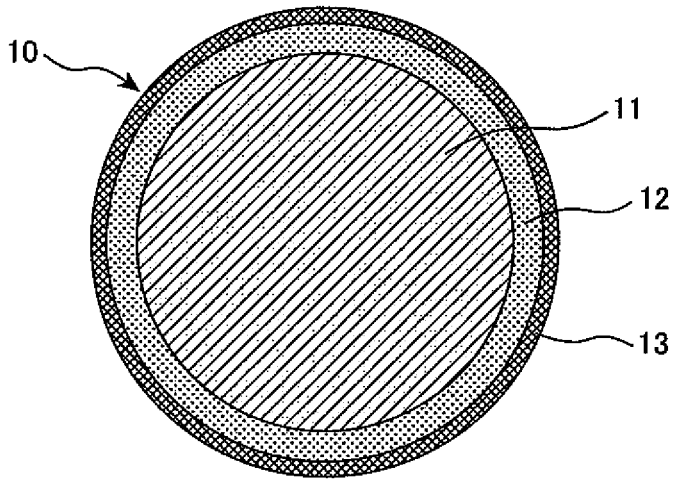
10
11
12
13

INSULATED ELECTRIC WIRE

CLAIM OF PRIORITY

The present application claims priority from Japanese patent application serial no. 2009-052103 filed on Mar. 5, 2009, the content of which is hereby incorporated by reference into this application.

BACKGROUND OF THE INVENTION

1. Field of the Invention

The present invention relates to an insulated electric wire, such as an enamel wire, which is superior in ease of coil insertion.

2. Description of Related Art

In a motor, a transformer, and the like, a plurality of coils, each of which is formed by winding an insulated electric wire, are inserted into, e.g., stator slots and then the ends of each of two inserted coils are mutually joined by welding or another method. Since an insulated electric wire is wound at high speed to form a coil, it is necessary to reduce the possibility in which excoriations are made on the surface of the insulated electric wire during the forming of the coil. Accordingly, there is a demand for insulated electric wires that are superior in ease of winding, i.e., have a highly lubricative surface.

In a method proposed to improve the lubrication property of an insulated electric wire, e.g., resin paint formed by adding a lubricant such as polyethylene oxide to a base resin is applied to an insulated layer and baked to form a lubricating layer (insulating coating) (see, e.g., JP-A 2007-213908). In another method proposed, resin paint formed by blending a stabilized isocyanate compound and lubricant in a base resin is applied to an electric conductor and baked to form a lubricating layer (see, e.g., JP-A Hei 9 (1997)-45143). In still another method proposed, resin paint formed by blending ester titanate in a base resin is applied to an electric conductor and baked to form a lubricating layer (see, e.g., JP-A Hei 7 (1995)-134912).

Recent motors and transformers are demanded to have high efficiency to save energy. To meet this demand, coils are inserted into stator slots so that almost no clearance is left therein, so as to increase the ratio of the cross section of the conductor of the insulated electric wire to the cross section of the stator slot (the ratio is called the space ratio). Accordingly, to reduce the possibility in which excoriations are generated on the surface of the insulated electric wire when the coil is inserted, it is also demanded that the insulated electric wire be superior in ease of coil insertion, i.e., a force to insert the coil into the stator slot be reduced.

Coils formed from conventional insulated electric wires have not been adequately easily inserted. A way to solve this problem has been to increase the amount of lubricant to be added to insulating paint so that these coils are easily inserted. In this case, however, the resulting coating (lubricating layer) has become cloudy due to the excessive lubricant, or bubbles, grains or unevenness have occurred on the surface of the coating, impairing its appearance (shape).

SUMMARY OF THE INVENTION

Under these circumstances, it is an objective of the present invention to address the above problems and to provide an insulated electric wire which is superior in ease of coil insertion and has a coating that is neither cloudy nor poor in appearance.

According to an aspect of the present invention, there is provided a new insulated electric wire with an electric conductor on which at least a lubricating layer is formed, in which a lubricant is added to the lubricating layer so that granular bodies, with sizes of 5 nm to 3 μm, which are formed by coagulation of the lubricant disperse on the surface of the lubricating layer.

In the above aspect of the present invention, the following modifications and changes can be made.

(i) A friction force of the surface of the lubricating layer is 9 nanonewton (nN) or less when the surface is measured with a scanning probe microscope under a load of 40 nN.

(ii) The lubricating layer is formed from resin paint prepared by adding a lubricant, a titanium coupling agent, and a cross-linking agent to a base resin.

(iii) The lubricant is formed from polyolefin wax or fatty acid ester wax or by mixing polyolefin wax and fatty acid ester wax, 1 to 12 parts by mass of the lubricant being added to 100 parts by mass of the base resin.

(iv) The cross-linking agent is formed from a polyisocyanate compound in which the isocyanate group at an end thereof is not stabilized by a masking agent.

(v) The ratio of the mass of the titanium coupling agent to the mass of the cross-linking agent is within a range of 1:200 to 1:10.

ADVANTAGES OF THE INVENTION

The present invention can provide an insulated electric wire which is superior in ease of coil insertion and has a coating that is neither cloudy nor poor in appearance.

BRIEF DESCRIPTION OF THE DRAWINGS

FIG. 1 is a schematic illustration showing a cross sectional view of an insulated electric wire of an embodiment according to the present invention.

DETAILED DESCRIPTION OF THE PREFERRED EMBODIMENTS

A preferred embodiment of the present invention will be described below with reference to the attached drawings. However, the present invention is not limited to the embodiment described herein.

The insulated electric wire in the present invention will be first described with reference to FIG. 1. FIG. 1 is a schematic illustration showing a cross sectional view of an insulated electric wire of an embodiment according to the present invention. As shown in FIG. 1, the insulated electric wire 10 in the present invention is formed by forming an insulating layer 12 with polyesterimide resin, polyamideimide resin, or the like on an electric conductor 11 and further forming a lubricating layer 13 on the outer circumference of the insulating layer 12, the lubricating layer 13 improving ease of coil insertion.

The insulating layer 12 includes, e.g., an inner insulating layer and an outer insulating layer, the inner insulating layer being formed by applying a polyesterimide paint to the outer circumference of the electric conductor 11 and baking the paint, the outer insulating layer being formed by applying a polyamideimide paint to the outer circumference of the inner insulating layer and backing the paint. The lubricating layer 13 is formed from resin paint prepared by adding a lubricant, a titanium coupling agent, and a cross-linking agent to a base resin; the lubricating layer including granular bodies, with sizes of 5 nm to 3 μm, which are formed by coagulation of the lubricant disperse on the surface of the lubricating layer.

When the surface of the lubricating layer in the present invention is observed as a shape image with a scanning probe microscope (SUM), granular bodies, with sizes of 5 nm to 3 μm, which are formed by coagulation of the lubricant disperse on the surface of the lubricating layer. A more preferable condition is that the lubricant disperses on the surface of the lubricating layer as granular bodies in a range of 50 to 200 nm in a planar direction on the surface of the lubricating layer.

When the lubricant disperses as granular bodies with sizes smaller than 5 nm on the surface of the lubricating layer, the lubricant does not adequately bleed on the surface of the lubricating layer, or it does not have adequate smoothness because of its decomposition due to heat during the baking of the paint, lowering the ease of coil insertion.

On the other hand, when the lubricant disperses as granular bodies with sizes larger than 3 μm on the surface of the lubricating layer, the lubricant easily turns into a thin film on part of the insulated electric wire, causing the lubricant to easily drop from the resin paint. Furthermore, since the lubricant is excessively present on the surface of the lubricating layer, the appearance (shape) of the insulated electric wire may be significantly impaired.

During diligent study, the inventors of the present invention found that, in control of the lubrication property of a coil, the friction force of the surface is preferably 9 nN or less when the surface is measured with a scanning probe microscope under a load of 40 nN. When the friction force on the surface of the lubricating layer, which is measured under the above condition, exceeds 9 nN, the ease of coil insertion is lowered.

The resin most suitable as the base resin used to prepare the resin paint in the present invention is polyamideimide resin. There is no particular limitation on the method of preparing polyamideimide resin; tricarboxylic anhydride and diisocyanate may be directly reacted with each other in a polar solvent, or tricarboxylic anhydride and diamine may be first reacted with each other in a polar solvent to form imide binding and then diisocyanate may be reacted as the cross-linking agent to introduce amide binding.

The lubricant used in the present invention is preferably formed from one of polyolefin wax, fatty acid ester wax, and the like or by mixing two or more types of wax selected from them. Polyolefin with a low molecular weight (polyethylene-based or polypropylene-based), oxidized polyethylene, and the like are applicable as the polyolefin wax, with its average molecular weight preferably being 1000 to 10000. These preferable average molecular weights are based on the fact that when the average molecular weight is less than 1000, the lubrication property becomes inadequate and thereby ease of coil insertion is lowered, and when the average molecular weight is more than 10000, the coating may become cloudy; or bubbles, grains or unevenness may occur on the surface of the insulated electric wire 10, significantly impairing its appearance (shape). Examples of the lubricant include, e.g., Hi-wax 110P (from Mitsui Chemicals, Inc.) and High Flat 2352 (from Gifu Shellac Manufacturing Co., Ltd.).

There is no particular limitation on the amount of the lubricant to be added if the granular body sizes and the friction force on the surface, which have been described above, or the ratio of the mass of the titanium coupling agent to the mass of the polyisocyanate compound (1:10 to 1:200), which will be described later, are within their respective ranges. However, 1 to 12 parts by mass of the lubricant are preferably added to 100 parts by mass of the base resin of the resin paint, and 1 to 10 parts by mass of the lubricant are more preferable. These preferable amounts of the lubricant to be added are based on the fact that when the amount of the lubricant to be added is less than 1 part by mass, the lubrication property becomes inadequate and thereby ease of coil insertion is lowered, and when the amount of the lubricant to be added is more than 12 parts by mass, the coating may become cloudy; or bubbles, grains or unevenness may occur on the surface of the insulated electric wire 10, significantly impairing its appearance (shape).

Any titanium coupling agent can be used in the present invention if it has a hydrophilic group and lipophilic group coupled to a titanium atom. Examples include isopropyl tri-octanoyl titanate, isopropyl tri-isostearoyl titanate, isopropyl tri-oleoyl titanate, isopropyl tri-palmitoyl titanate, isopropyl tri-dodecylbenzene sulfonyl titanate, isopropyl tri-(dioctyl pyrophosphate) titanate, isopropyl dimethacryl isostearoyl titanate, isopropyl isostearoyl diacryl titanate, isopropyl tri-(dioctyl phosphate) titanate, bis-(dioctyl pyrophosphate) oxyacetate titanate, bis-(dioctyl pyrophosphate) ethylene titanate, diisostearoyl ethylene titanate, tetra-isopropyl bis-(dioctyl phosphite) titanate, tetra-octyl bis-(ditridecyl phosphite) titanate, and tetra-(2,2-diallyl oxymethyl-1-buthyl) bis-(di-tridecyl phosphite) titanate. Of these, isopropyl tri-isostearoyl titanate, isopropyl tri-(dioctyl pyrophosphate) titanate, isopropyl tri-octanoyl titanate, etc. are most suitable.

There is no particular limitation on the amount of the titanium coupling agent to be added if the granular body sizes and the friction force on the surface, which have been described above, or the ratio of the mass of the titanium coupling agent to the mass of the polyisocyanate compound (1:10 to 1:200), which will be described later, are within their respective ranges. However, 0.1 to 12 parts by mass of the titanium coupling agent are preferably added to 100 parts by mass of the base resin of the resin paint, and 0.1 to 10 parts by mass of the titanium coupling agent are more preferable. These preferable amounts of the titanium coupling agent to be added are based on the fact that when the amount of the titanium coupling agent to be added is less than 0.1 part by mass, the lubrication property becomes inadequate and thereby ease of coil insertion is lowered, and when the amount of the titanium coupling agent to be added is more than 12 parts by mass, the appearance (shape) of the insulated electric wire 10 may be significantly impaired.

A polyisocyanate compound which has at least two isocyanate groups at the end thereof can be used as the cross-linking agent in the present invention, regardless whether or not the isocyanate groups are stabilized by a masking agent. In other words, can be used both a polyisocyanate compound having the isocyanate groups completely stabilized by a masking agent and one having the isocyanate groups not stabilized by a masking agent.

The polyisocyanate compound having the isocyanate groups completely stabilized by a masking agent has a merit in which the polyisocyanate compound is stable and easy to be handled before cross-linking (including storage). However, when the isocyanate groups in the polyisocyanate compound are completely stabilized by a masking agent, in order to obtain efficiently a cross-linking effect, the masking agent needs to be removed by an external factor such as heat and thereby the baking temperature should be managed accurately in a manufacturing process. On the other hand, when a polyisocyanate compound having a part where the isocyanate group is not stabilized by a masking agent is used, cross-linking in that polyisocyanate compound is likely to proceed faster than cross-linking in a stabilized polyisocyanate compound and the baking temperature is easy to manage in the manufacturing process. That is, when a polyisocyanate compound having a part where the isocyanate group is not stabilized is used, a cross-linking effect is easier to obtain than before, and thereby an increase in production efficiency can be expected.

A polyisocyanate compound having a non-stabilized part can be prepared by, for example, mutually reacting alcohol having at least two hydroxyl groups at the end thereof and diphenyl methane diisocyanate to form a polyisocyanate compound and adding the polyisocyanate compound to a base paint without stabilizing the isocyanate group at the end thereof by a masking agent. Examples of alcohol having at least two hydroxyl groups at the end thereof include, but are not limited to, ethylene glycol, diethylene glycol, glycerine, diglycerine, trimethylol propane, and pentaerythritol.

When a polyisocyanate compound having a non-stabilized part (hereafter, simply referred to as "non-stabilized polyisocyanate compound") is used, the viscosity of the base paint is predicted to increase with an elapse of time. However, this problem is solved by adding a masking agent to the base paint in advance, and the same effect as a completely stabilized polyisocyanate compound is obtained. Examples of the masking agent to be added to the base paint in advance include, but are not limited to, methanol, ethanol, phenol, cresol, xylenol, and MEK oxime.

On the other hand, specific examples of the completely stabilized polyisocyanate compound include Desmodur AP Stable and Desmodur CT Stable from Sumitomo Bayer Urethane Company, Limited as well as Millionate MS-50 and Coronate 2503 from Nippon Polyurethane Industry Co., Ltd.

Although there is no particular limitation on the amount of the polyisocyanate compound to be added if the granular body sizes and the friction force on the surface, which have been described above, or the ratio of the mass of the titanium coupling agent to the mass of the polyisocyanate compound (1:10 to 1:200), which will be described later, are within their respective ranges, 1 to 220 parts by mass of the polyisocyanate compound are preferably added to 100 parts by mass of the base resin of the resin paint, and 1 to 200 parts by mass of the polyisocyanate compound are more preferable. These preferable amounts of the polyisocyanate compound to be added are based on the fact that when the amount of the polyisocyanate compound to be added is less than 1 part by mass, the lubrication property becomes inadequate and thereby ease of coil insertion is lowered, and when the amount of the polyisocyanate compound to be added is more than 220 parts by mass, the appearance (shape) of the insulated electric wire 10 may be significantly impaired.

Furthermore, the ratio of the mass of the titanium coupling agent to the mass of the polyisocyanate compound is preferably within a range of 1:200 to 1:10. This preferable range is based on the fact that when the ratio is greater than 1:10, the lubrication property becomes inadequate and thereby ease of coil insertion is lowered, and when the ratio is smaller than 1:200, the appearance (shape) of the insulated electric wire 10 may be significantly impaired.

The reason why the ease of coil insertion of the enamel wire (insulated electric wire) in the present invention is improved can be inferred as follows.

The polyisocyanate compound enhances bleeding of the lubricant to lower the hardness of the coating (lubricating layer 13) when a reaction for hardening by baking is caused, and the titanium coupling agent exhibits the same effect as the lubricant, so the base resin becomes lubricative.

Herein, when an inorganic coupling agent is added after the hardness of the coating (lubricating layer 13) is lowered, the hardness of the coating (lubricating layer 13) may be predicted to increase. This can be thought to be an undesirable behavior. However, it can be inferred that the titanium coupling agent does not impede the property of the polyisocyanate compound depending on its addition ratio, and that since the hydrophile part of the titanium coupling agent reacts with the base resin and binds to it, the lipophilicity of the titanium coupling agent is added to the resin, enhancing the bleeding of the lubricant.

Specifically, it can be thought that when the ratio of the mass of the titanium coupling agent to the mass of the polyisocyanate compound is within a range of 1:10 to 1:200, the lubricant becomes more likely to bleed due to a synergistic effect caused by use of both the titanium coupling agent and polyisocyanate compound. And thereby the lubrication property of the surface of the lubricating layer 13 is significantly improved, so the ease of coil insertion is improved.

Since a polyisocyanate compound having a part where the isocyanate group at the end thereof is not stabilized by a masking agent is used as a cross-linking agent, cross-linking in the present invention is more likely to proceed than that in a conventional technique using a completely stabilized polyisocyanate compound, enabling a cross-linking effect to be easily obtained. As a result, the production efficiency can be increased and the baking temperature in the manufacturing process becomes easy to manage.

Although polyamideimide resin is used as the base resin of the resin paint in the above embodiment, this is not a limitation. Even when polyamide resin, polyimide resin, polyester resin, or polyester imide resin is used, the same effect can be obtained.

In the above embodiment, the insulating layer 12 includes two layers, which are an inner insulating layer and an outer insulating layer. Instead, the insulating layer 12 may have only one layer formed from polyester imide resin, with the lubricating layer 13 being formed around the outer circumference of the insulating layer 12.

EXAMPLES

Next, the present invention will be described by referring examples and comparative examples. Insulated electric wires used in the examples and comparative examples were manufactured as described below.

Polyester imide paint EH-402-40 from Dainichiseika Color & Chemicals Mfg. Co., Ltd. was applied to a copper conductor with a diameter of 0.8 mm so that a coating with a thickness of 25 μm was formed, and the applied paint was baked. Polyamide imide paint HI-406-30 from Hitachi Chemical Co., Ltd. was then applied to the outer circumference of the coating so that another coating with a thickness of 5 μm was formed, producing a base wire with a total insulating layer thickness of 30 μm. After that, paint indicated in Table 1 provided later was applied to the outer circumference of the base wire so that a coating with a thickness of 3 μm was formed and then the paint was baked, so as to obtain various types of insulated electric wires (Examples 1 and 2, and Comparative examples 1 to 6).

The ease of coil insertion of these insulated electric wires was measured. In measurement of the ease of coil insertion, coils were manufactured by using the DTW-T2N winding machine of the flyer winding type from Hibo Engineering Ltd. so that the space ratio became 70%; each coil was inserted into a core by using the coil insertion machine TZ-E from Toyo Gauge Co., Ltd.; and a force to insert the coil was evaluated by using a load cell.

On the other hand, the surface of the lubricating layer of each insulated electric wire was investigated by using a scanning probe microscope (SPM). For each sample wire, a shape image and friction image (friction force) were observed and measured with the scanning probe microscope. The scanning probe microscope was the E-sweep Nano Navi station from SII Nano Technology Inc. As for its cantilever, the spring constant was 0.13 N/m, the torsion constant was 81.3 N/m, the resonant frequency was 12.0 kHz, the lever length was 450 μm, and the needle height was 12.5 μm. In evaluation of the sample wire, a load of 40 nN was applied at 25° C. under a vacuum atmosphere made by a rotary pump.

Example 1

In order to obtain a paint for Example 1, 3 parts by mass of Hi-wax 110P (from Mitsui Chemicals, Inc.) were added as the lubricant to polyamideimide resin in 100 parts by mass of the polyamideimide paint HI-406-30 (from Hitachi Chemical Co., Ltd.). In addition, 1 part by mass of Plain Act KR41B (from Ajinomoto Fine-Tech Co., Inc.) was added as the titanium coupling agent to the polyamideimide resin, and 50 parts by mass of a non-stabilized polyisocyanate compound were added as the polyisocyanate compound to the polyamideimide resin, the compound being prepared by a reaction of trimethylol propane and diphenylmethane diisocyanate at a molecular ratio of 1:3 in a polar solvent. Next, the obtained paint was applied to the base wire described above and baked to obtain the insulated electric wire of Example 1.

Example 2

The insulated electric wire of Example 2 was obtained at a different blending ratio from Example 1, specifically 10 parts by mass of the titanium coupling agent, 200 parts by mass of the non-stabilized polyisocyanate compound, and 10 parts by mass of the lubricant were added.

Comparative Example 1

The insulated electric wire of Comparative example 1 was obtained at the same blending as in Example 1 except that 0.05 parts by mass of the titanium coupling agent was added.

Comparative Example 2

The insulated electric wire of Comparative example 2 was obtained at the same blending as in Example 1 except that 0.5 parts by mass of the non-stabilized polyisocyanate compound was added.

Comparative Example 3

The insulated electric wire of Comparative example 3 was obtained at the same blending as in Example 1 except that 0.5 parts by mass of the lubricant was added.

Comparative Example 4

The insulated electric wire of Comparative example 4 was obtained at the same blending as in Example 1 except that 15 parts by mass of the titanium coupling agent were added.

Comparative Example 5

The insulated electric wire of Comparative example 5 was obtained at the same blending as in Example 1 except that 300 parts by mass of the non-stabilized polyisocyanate compound were added.

Comparative Example 6

The insulated electric wire of Comparative example 6 was obtained at the same blending as in Example 1 except that 15 parts by mass of the lubricant were added.

Table 1 indicates the compositions and properties of Examples 1 and 2, and Comparative examples 1 to 6.

TABLE 1

| | Example 1 | Example 2 | Comparative example 1 | Comparative example 2 | Comparative example 3 | Comparative example 4 | Comparative example 5 | Comparative example 6 |
|---|---|---|---|---|---|---|---|---|
| Polyamideimide paint *1 | 100.0 | 100.0 | 100.0 | 100.0 | 100.0 | 100.0 | 100.0 | 100.0 |
| Titanium coupling agent *2 | 1.0 | 10.0 | 0.05 | 1.0 | 1.0 | 15.0 | 1.0 | 1.0 |
| Polyisocyanate compound | 50.0 | 200.0 | 50.0 | 0.5 | 50.0 | 50.0 | 300.0 | 50.0 |
| Lubricant *3 | 3.0 | 10.0 | 3.0 | 3.0 | 0.5 | 3.0 | 3.0 | 15.0 |
| Granular body size (criterion: 5 nm to 3 μm) | 5 nm | 3 μm | 3 nm | 2 nm | 1 nm | 5 μm | 6 μm | 8 μm |
| State of lubricant | Lubricant was formed like a thin film. | | Lubricant was excessively thin and lubricating property was inadequate. | | | Lubricant was formed like a thin film. | | |
| Friction force (nN) measured with scanning probe microscope (criterion: 9 nN or less) | 7.9 | 7.8 | 12.3 | 10.6 | 13.3 | 7.4 | 7.1 | 7.8 |
| Ease of coil insertion (criterion: 5.0 kN or less) | 4.5 | 4.2 | 5.2 | 5.3 | 5.7 | 4.3 | 4.1 | 4.0 |
| Appearance (shape) (criterion: no abnormality) | Good | Good | Good | Good | Good | Bad | Bad | Bad |

*1: Polyamideimide paint, HI-406-30 from Hitachi Chemical Co., Ltd.

*2: Titanium coupling agent, Plain Act KR 41B from Ajinomoto Fine-Tech Co., Inc.

*3: Lubricant, polyethylene with a low molecular weight, Hi-wax 110P from Mitsui Chemicals, Inc.

As seen from Table 1, the insulated electric wires obtained in Examples 1 and 2 exhibited superior ease of coil insertion and appearance (shape). For the insulated electric wires in Comparative examples 1 to 3, the titanium coupling agent, polyisocyanate compound, and lubricant were blended by amounts less than their criteria, so their ease of coil insertion was low. For the insulated electric wires in Comparative examples 4 to 6, the titanium coupling agent, polyisocyanate compound, and lubricant were blended by amounts more than their criteria, so their appearance (shape) was poor.

As described above, the insulated electric wires (self-lubricating enamel wires) obtained in the present invention are superior in ease of coil insertion and appearance (shape).

Although, in the above examples, polyamideimide resin was used as the base resin of the insulating paint, the use of polyamide resin, polyimide resin, polyester resin, or polyesterimide resin also provides the same effect. Although, in the above examples, two layers were used to form an insulating layer, the lubricating layer according to the present invention may be formed on an insulating layer formed from polyesterimide resin. Furthermore, the above insulating layer may be a partial discharge resistant insulating layer, having high partial discharge resistant performance, that is formed by applying partial discharge resistant insulating paint, in which organosol including fine silica particles or the like are dispersed, to the above insulating paint formed from the base resin and baking the resulting paint.

Although the cross section of the electric conductor was circular, this is not a limitation. The electric conductor may have a square or rectangular cross section. The electric conductor may be made of copper or aluminum. In addition, it may be made of low-oxygen copper or oxygen-free copper.

Although the present invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An insulated electric wire with an electric conductor on which at least a lubricating layer is formed, wherein the lubricating layer is formed from resin paint prepared by adding a lubricant, a titanium coupling agent, and a cross-linking agent to a base resin;

the titanium coupling agent has a hydrophilic group and a lipophilic group coupled to a titanium atom; and the lubricating layer includes coagulation of the lubricant dispersed on a surface of the lubricating layer as granular bodies having sizes of 5 nm to 3 μm.

2. The insulated electric wire according to claim 1, wherein a friction force of the surface of the lubricating layer is 9 nanonewton (nN) or less when the surface is measured with a scanning probe microscope under a load of 40 nN.

3. The insulated electric wire according to claim 1, wherein the lubricant is formed from polyolefin wax or fatty acid ester wax or by mixing polyolefin wax and fatty acid ester wax, 1 to 12 parts by mass of the lubricant being added to 100 parts by mass of the base resin.

4. The insulated electric wire according to claim 1, wherein the cross-linking agent is formed from a polyisocyanate compound in which an isocyanate group at an end thereof is not stabilized by a masking agent.

5. The insulated electric wire according to claim 1, wherein a ratio of a mass of the titanium coupling agent to a mass of the cross-linking agent is within a range of 1:200 to 1:10.

6. The insulated electric wire according to claim 1, wherein the base resin of the resin paint is selected from the group consisting of a polyamideimide resin, a polyamide resin, a polyimide resin, a polyester resin, and a polyester imide resin.

7. An insulated electric wire with an electric conductor on which at least a lubricating layer is formed, wherein the lubricating layer is formed from resin paint prepared by adding a lubricant, a titanium coupling agent, and a cross-linking agent to a base resin;

the cross-linking agent is formed from a polyisocyanate compound in which an isocyanate group at an end thereof is not stabilized by a masking agent; and the lubricating layer includes coagulation of the lubricant dispersed on a surface of the lubricating layer as granular bodies having sizes of 5 nm to 3 μm.

8. The insulated electric wire according to claim 7, wherein a friction force of the surface of the lubricating layer is 9 nanonewton (nN) or less when the surface is measured with a scanning probe microscope under a load of 40 nN.

9. The insulated electric wire according to claim 7, wherein the lubricant is formed from polyolefin wax or fatty acid ester wax or by mixing polyolefin wax and fatty acid ester wax, 1 to 12 parts by mass of the lubricant being added to 100 parts by mass of the base resin.

10. The insulated electric wire according to claim 7, wherein a ratio of a mass of the titanium coupling agent to a mass of the cross-linking agent is within a range of 1:200 to 1:10.

11. The insulated electric wire according to claim 7, wherein the base resin of the resin paint is selected from the group consisting of a polyamideimide resin, a polyamide resin, a polyimide resin, a polyester resin, and a polyester imide resin.

12. An insulated electric wire comprising:

an electric conductor; and a lubricating layer disposed over an outer circumference of the electric conductor, the lubricating layer being formed from resin paint including a base resin, a lubricant, a titanium coupling agent, and a cross-linking agent;

wherein the cross-linking agent is formed from a polyisocyanate compound in which an isocyanate group at an end thereof is not stabilized by a masking agent, and wherein the lubricating layer includes coagulation of the lubricant dispersed on a surface of the lubricating layer as granular bodies having sizes of 5 nm to 3 μm.

13. The insulated electric wire according to claim 12, wherein the titanium coupling agent has a hydrophilic group and a lipophilic group coupled to a titanium atom.

14. The insulated electric wire according to claim 12, wherein a friction force of the surface of the lubricating layer is 9 nanonewton (nN) or less when the surface is measured with a scanning probe microscope under a load of 40 nN.

15. The insulated electric wire according to claim 12, wherein the lubricant is formed from polyolefin wax or fatty acid ester wax or by mixing polyolefin wax and fatty acid ester wax, 1 to 12 parts by mass of the lubricant being added to 100 parts by mass of the base resin.

16. The insulated electric wire according to claim 12, wherein a ratio of a mass of the titanium coupling agent to a mass of the cross-linking agent is within a range of 1:200 to 1:10.

17. The insulated electric wire according to claim 12, wherein the base resin of the resin paint is selected from the group consisting of a polyamideimide resin, a polyamide resin, a polyimide resin, a polyester resin, and a polyester imide resin.

* * * * *